US007807324B2

(12) United States Patent
Hu et al.

(10) Patent No.: US 7,807,324 B2
(45) Date of Patent: Oct. 5, 2010

(54) PHOTOCONDUCTORS

(75) Inventors: Nan-Xing Hu, Oakville (CA); Yvan Gagnon, Mississauga (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/521,933

(22) Filed: Sep. 15, 2006

(65) Prior Publication Data

US 2008/0070136 A1 Mar. 20, 2008

(51) Int. Cl.
*G03G 5/043* (2006.01)

(52) U.S. Cl. ..... 430/66; 430/59.6; 430/60; 430/65; 430/59.4

(58) Field of Classification Search ..... 430/58.8, 430/59.4, 60, 65, 66
See application file for complete search history.

(56) References Cited

U.S. PATENT DOCUMENTS

| | | | | |
|---|---|---|---|---|
| 4,265,990 | A | 5/1981 | Stolka et al. | |
| 4,286,033 | A | 8/1981 | Neyhart et al. | |
| 4,291,110 | A | 9/1981 | Lee | |
| 4,338,387 | A | 7/1982 | Hewitt | |
| 4,464,450 | A | 8/1984 | Teuscher | |
| 4,500,622 | A * | 2/1985 | Horie et al. | 430/78 |
| 4,555,463 | A | 11/1985 | Hor et al. | |
| 4,587,189 | A | 5/1986 | Hor et al. | |
| 4,871,634 | A * | 10/1989 | Limburg et al. | 430/58.6 |
| 4,921,769 | A | 5/1990 | Yuh et al. | |
| 4,921,773 | A | 5/1990 | Melnyk et al. | |
| 5,702,854 | A * | 12/1997 | Schank et al. | 430/119.6 |
| 6,261,729 | B1 | 7/2001 | Yuh et al. | |
| 6,756,169 | B2 | 6/2004 | Lin et al. | |
| 6,913,863 | B2 | 7/2005 | Wu et al. | |
| 6,946,226 | B2 | 9/2005 | Wu et al. | |
| 6,946,227 | B2 | 9/2005 | Lin et al. | |
| 7,037,631 | B2 | 5/2006 | Wu et al. | |
| 2002/0119382 | A1 * | 8/2002 | Nakata et al. | 430/66 |
| 2003/0194625 | A1 * | 10/2003 | Tanaka et al. | 430/58.8 |
| 2004/0202947 | A1 * | 10/2004 | Wu et al. | 430/59.4 |
| 2007/0048636 | A1 * | 3/2007 | Qi et al. | 430/58.75 |
| 2007/0087277 | A1 * | 4/2007 | Qi et al. | 430/58.55 |
| 2007/0298342 | A1 * | 12/2007 | Wu et al. | 430/58.75 |

FOREIGN PATENT DOCUMENTS

JP 2003-246771 * 9/2003

OTHER PUBLICATIONS

Diamond, Handbook of Imaging Materials, Marcel Dekker, Inc. NY, NY, 1991. p. 398-399.*
Machine generated translation of JP 2003-246771, published Sep. 2003.*

* cited by examiner

*Primary Examiner*—Mark F Huff
*Assistant Examiner*—Peter L Vajda
(74) *Attorney, Agent, or Firm*—Pillsbury Winthrop Shaw Pittman LLP

(57) ABSTRACT

An imaging member containing an optional supporting substrate, a photogenerating layer, a charge transport layer, and an overcoat layer comprised, for example, of a phenolic resin containing a phenolic charge transport component.

16 Claims, No Drawings

PHOTOCONDUCTORS

BACKGROUND

This disclosure is generally directed to layered imaging members, photoreceptors, photoconductors, and the like. More specifically, the present disclosure is directed to multilayered imaging members, or devices comprised of a supporting medium like a substrate, a photogenerating layer, a charge transport layer and a layer in contact with the charge transport layer comprised of a suitable charge transport component and a phenolic resin. In embodiments, there is disclosed a drum or flexible belt photoconductor comprised of a supporting substrate, a photogenerating layer, a charge transport layer, and coated on the transport layer an overcoat layer comprised of a dihydroxy aryl amine and a phenolic resin wherein this layer can be generated from the crosslinking of a phenolic resin containing the dihydroxy aryl amine in the presence of a mask organic acid catalyst and which overcoat possesses a number of desirable characteristics, such as stable long term xerographic cycling, excellent electrical characteristics, and low BCR wear rates, that is the overcoat is wear resistant during electrophotographic, such as xerographic, imaging cycles.

The photoreceptors illustrated herein, in embodiments, have excellent wear resistance, extended lifetimes, provide for the elimination or minimization of imaging member scratches on the surface layer or layers of the member, and which scratches can result in undesirable print failures where, for example, the scratches are visible on the final prints generated. Additionally, in embodiments the imaging members disclosed herein possess excellent, and in a number of instances low $V_r$ (residual potential), and allow the substantial prevention of $V_r$ cycle up when appropriate; high sensitivity; low acceptable image ghosting characteristics; and desirable toner cleanability.

Also included within the scope of the present disclosure are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697 and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, the scratch and wear resistant imaging members on drums or flexible belts disclosed herein can be selected for printers/copiers, and the Xerox Corporation iGEN3® machines that generate with some versions over 100 copies per minute. Processes of imaging, especially xerographic imaging and printing, including digital, and/or color printing, are thus encompassed by the present disclosure. The imaging members are in embodiments sensitive in the wavelength region of, for example, from about 400 to about 900 nanometers, and in particular from about 650 to about 850 nanometers, thus diode lasers can be selected as the light source. Moreover, the imaging members of this disclosure are useful in color xerographic applications, particularly high-speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide, and a mixture of a phenolic compound and a phenolic resin wherein the phenolic compound contains at least two phenolic groups.

A number of the components and amounts thereof of the above patents, such as the supporting substrates, resin binders, photogenerating layer components, antioxidants, hole blocking layer components, and the like, may be selected for the members of the present disclosure in embodiments thereof.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound and an amine hole transport dispersed in an electrically insulating organic resin binder.

In U.S. Pat. No. 4,555,463 there is illustrated a layered imaging member with a chloroindium phthalocyanine photogenerating layer. In U.S. Pat. No. 4,587,189, the disclosure of which is totally incorporated herein by reference, there is illustrated a layered imaging member with, for example, a perylene photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport binders, can be selected for the imaging members of the present disclosure in embodiments thereof.

U.S. Pat. No. 4,871,634, the disclosure of which is totally incorporated herein by reference, discloses an electrostatographic imaging member which contains at least one electrophotoconductive layer, the imaging member comprising a photogenerating material, and a hydroxy arylamine compound represented by a certain formula. The hydroxy arylamine compound can be used in an overcoating with the hydroxy arylamine compound bonded to a resin capable of hydrogen bonding such as a polyamide possessing alcohol solubility.

In U.S. Pat. No. 4,921,769, the disclosure of which is totally incorporated herein by reference, there are illustrated photoconductive imaging members with blocking layers of certain polyurethanes.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine whereby a pigment precursor Type I chlorogallium phthalocyanine is prepared by reaction of gallium chloride in a solvent, such as N-methylpyrrolidone, present in an amount of from about 10 parts to about 100 parts, and preferably about 19 parts with 1,3-diiminoisoindolene ($DI^3$) in an amount of from about 1 part to about 10 parts, and preferably about 4 parts of $DI^3$ for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

The appropriate components, and processes of the above recited patents may be selected for the photoconductors of the present disclosure in embodiments thereof.

SUMMARY

Disclosed are imaging members with many of the advantages illustrated herein, such as in embodiments extended lifetimes of service of, for example, in excess of about 1,000,000 imaging cycles; stable electrical properties; low image ghosting; excellent surface characteristics; excellent wear resistance; the avoidance of or minimal imaging member scratching characteristics; resistance to charge transport layer cracking upon exposure to corona effluents; compatibility with a number of toner compositions; consistent $V_r$ (residual potential) that is substantially flat or no change over a number of imaging cycles as illustrated by the generation of known PIDC (Photo-induced Discharge Curve), and the like.

Also disclosed are wear resistant layered photoresponsive imaging members which are responsive to near infrared radiation of from about 700 to about 900 nanometers; layered photoresponsive imaging members with sensitivity to visible light; layered photoresponsive or photoconductive imaging members with mechanically robust and corona resistant charge transport layers; imaging members with optional hole blocking layers comprised of metal oxides and polymer resins, such as phenolic resins, and wherein a hole blocking layer with excellent efficient electron transport usually results in a desirable photoconductor low residual potential $V_{low}$; and layered photoreceptors containing a wear resistant, charge transport overcoating layer where the surface hardness of the member is increased as compared, for example, to similar photoconductors without the overcoating layer, and wherein there is prevention or minimized $V_r$ cycle up, caused primarily by photoconductor aging, for numerous imaging cycles.

EMBODIMENTS

Aspects of the present disclosure relate to an imaging or photoconductive member, for example a drum or a flexible imaging member, comprising a supporting substrate, a photogenerating layer, at least one charge transport layer, and an overcoat layer comprised of a charge transport phenolic resin, and more specifically, a crosslinked phenolic resin containing a phenolic aryl amine; a photoconductive member with a photogenerating layer of a thickness of from about 0.1 to about 10 microns, and charge transport layer of a thickness of from about 5 to about 100 microns; an imaging method and an imaging apparatus comprising a charging component, a development component, a transfer component, a cleaning station and a fixing component, and wherein the apparatus contains a photoconductive imaging member comprised of a supporting substrate, a layer comprised of a photogenerating pigment, at least one charge transport layer containing, for example, hole transporting molecules and a resin binder, and thereover an overcoat layer of a thickness of, for example, from about 0.5 to about 10 microns or from about 1 to about 8 microns, and more specifically, from about 2 to about 6 microns; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating layer contains a photogenerating pigment present in an amount of from about 15 to about 95 weight percent; a member wherein the thickness of the photogenerating layer is from about 0.1 to about 4 microns; an imaging member wherein the photogenerating layer contains a polymer binder, and where the binder is present in an amount of from about 50 to about 90 percent by weight, and wherein the total of all layer components is about 100 percent; an imaging member wherein the photogenerating pigment is a metal free phthalocyanine; an imaging member wherein the photogenerating pigment present in the photogenerating layer is comprised of chlorogallium phthalocyanine; an imaging member wherein the photogenerating component is a hydroxygallium phthalocyanine that absorbs light of a wavelength of from about 370 to about 900 nanometers; an imaging member wherein the photogenerating component is a hydroxygallium phthalocyanine Type V; an imaging member wherein the Type V hydroxygallium phthalocyanine has major peaks, as measured with an X-ray diffractometer, at Bragg angles (2 theta+/−0.2°) of 7.4, 9.8, 12.4, 16.2, 17.6, 18.4, 21.9, 23.9, 25.0, 28.1 degrees, and the highest peak at 7.4 degrees; an imaging member wherein the photogenerating resinous binder is selected from the group consisting of polyesters, polyvinyl butyrals, polycarbonates, polystyrene-b-polyvinyl pyridine, and polyvinyl formals; a method of imaging which comprises generating an electrostatic latent image on an imaging member developing the latent image, and transferring the developed electrostatic image to a suitable substrate; a method of imaging wherein the imaging member is exposed to light of a wavelength of from about 370 to about 950 nanometers; an imaging apparatus comprising a charging component, a development component, a transfer component, and a fixing component; and wherein the apparatus contains a photoconductive member comprised of a supporting substrate, and thereover a layer comprised of photogenerating pigments; a charge transport layer; a hole blocking layer; an adhesive layer; and an overcoat layer comprised of a crosslinked mixture of a phenol resin containing a charge transport component, and wherein the blocking layer is in contact with the substrate and the adhesive layer is situated between the blocking layer and the photogenerating layer; a photoconductive imaging member wherein a photogenerating pigment and a charge transport component are in the same layer along with a binder resin, for example as disclosed in U.S. Pat. Nos. 6,756,169 and 6,946,227, the disclosures of which are totally incorporated herein by reference; a photoconductive imaging member with a blocking layer contained as a coating on a substrate, and an optional adhesive layer coated on the blocking layer; a photoconductive imaging member with a blocking layer, wherein the blocking layer is comprised of a polysiloxane formed from, for example, a 3-aminopropyl trialkoxysilane; a photoconductive imaging member with a blocking layer comprised of metal oxide and a polymer binder; an imaging member comprising a supporting substrate, a photogenerating layer, a charge transport layer, and an overcoat layer comprised of a phenol resin containing a phenolic charge transport component of Formula 1

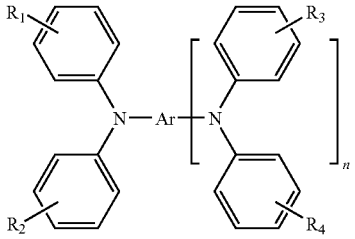

wherein $R_1$, $R_2$, $R_3$, and $R_4$ are each independently selected from the group consisting of at least one of a hydroxyl, a hydrogen, a suitable hydrocarbon, such as alkyl, alkoxy, aryl, and aryloxy; and a halogen atom; Ar is an aromatic hydrocarbon group; and n represents the number of groups, and more specifically, wherein n is a number of, for example, 0, 1, 2, 3, 4 or 5, and wherein at least two of $R_1$, $R_2$, $R_3$, and $R_4$ are hydroxyl; and a photoconductor comprising in sequence of a conductive substrate, a blocking layer thereover, a photogenerating layer, at least one charge transport layer, and an overcoat layer comprised of a crosslinked, for example from about 5 to about 90 percent, mixture of a phenol resin and a phenolic charge transport component of Formula 1

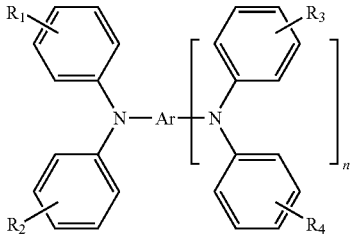

wherein $R_1$, $R_2$, $R_3$, and $R_4$, are selected from the group consisting of at least one of a hydroxyl, a hydrogen, an alkyl, an alkoxy, an aryl, an aryloxy, and a halogen; Ar is an aromatic hydrocarbon group, n represents the number of repeating units, and wherein at least two of $R_1$, $R_2$, $R_3$, and $R_4$ are hydroxyl groups.

In embodiments, the imaging members of the present disclosure include an overcoat layer with mechanically robust surface characteristics, such as reduced wear, improved scratch resistance, less cracking, stable electrical properties and high photoconductive sensitivity, wherein the overcoat layer is comprised of a phenol resin containing a phenolic charge transport component of Formula 1

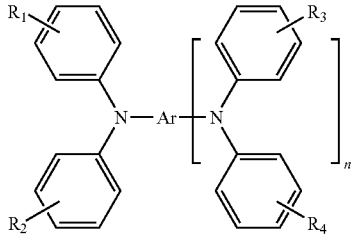

wherein $R_1$, $R_2$, $R_3$, and $R_4$, are each independently selected from the group consisting of at least one of hydroxyl, hydrogen; a suitable hydrocarbon, such as an alkyl, an alkoxy, an aryl, an aryloxy; and a halogen, and the like; Ar is an aromatic hydrocarbon group, and n is a number of from about or between about zero to about 5, and wherein at least two, such as from 2 to about 4, of $R_1$, $R_2$, $R_3$, and $R_4$ are hydroxyl groups. Alkyl and alkoxy each may contain, for example, from about 1 to about 12 carbon atoms, and aryl may contain, for example, from about 6 to about 36 carbon atoms. The benzene rings and the Ar groups disclosed herein may further contain a substituent such as an alkyl, an alkoxy, a halogen, and the like.

Illustrative examples of alkyl groups include methyl, ethyl, propyl, butyl, pentyl, hexyl, octyl, nonoyl, decyl, isomers thereof, substituted derivatives thereof, and the like. Examples of the aromatic Ar group with, for example, from 6 to about 42 carbon atoms include a biphenyl, a terphenyl, a tetraphenyl, a naphthalene, a fluorene, and the like. Alkoxy includes methoxy, ethoxy, propoxy, butoxy, pentyloxy, hexaloxy, heptyloxy, isomers thereof, substituted derivatives thereof, and the like. Examples of aryl groups with, for example, from 6 to about 42 carbon atoms are phenyl, naphthyl, biphenylyl, and the like.

More specifically, examples of phenolic aryl amines are represented by the following formula Formula 2

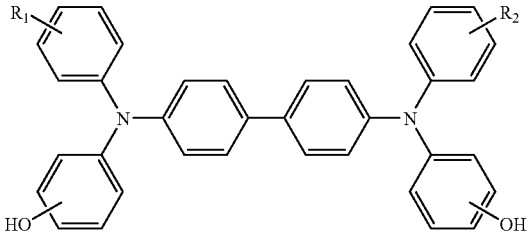

wherein $R_1$ and $R_2$ are each independently selected from the group consisting of a hydrogen atom, alkyl, alkoxy, aryl, and aryloxy with from about 6 to about 30 carbons, such as a phenoxy, a tolyloxy, a biphenylyloxy, and the like; and a halogen atom, and the like, wherein the hydroxyl group may be in the meta or in para position. Specific examples of the phenolic charge transport component includes N,N'-bis(3-hydroxyphenyl)-N,N'-diphenyl-1,1'-biphenyl-4,4'-diamine, N,N'-bis(4-hydroxyphenyl)-N,N'-diphenyl-1,1'-biphenyl-4,4'-diamine, N,N'-bis(4-hydroxyphenyl)-N,N'-di-m-tolyl-1, 1'-biphenyl-4,4'-diamine, N,N'-bis(hydroxyphenyl)-N,N'-di-p-tolyl-1,1'-biphenyl-4,4'-diamine, N,N'-bis(3-hydroxyphenyl)-N,N'-di-m-methoxyphenyl-1,1'-biphenyl-4,4'-diamine, and the like.

Phenolic resin examples are as illustrated herein including suitable known phenolic resins, many of which are commercially available, such as a resole-type phenolic resin or a novolac-type phenolic resin. A resole-type phenolic resin may be formed through a reaction between a phenol and an aldehyde in the presence of a base catalyst. A novolac-type resin may be formed through a reaction between a phenol and an aldehyde in the presence of an acid catalyst. The molecular weight $M_w$ of the phenol resin may be, for example, from about 300 to about 50,000, or from about 500 to about 35,000.

For resole-type phenolic resin (or resole phenolic resins), a weight average molecular weight of the resin may be, for example, from about 300 to about 50,000, from about 500 to about 35,000 or from about 1,000 to about 35,000, for example as determined by known methods such as gel permeation chromatography. Resole phenolic resins that may be selected include, for example, PL4852™ (Gun'ei Kagaku Kogyo K.K.), formaldehyde polymers with phenol, p-tert-butylphenol and cresol, such as VARCUM® 29159 and 29101 (OxyChem Company) and DURITE® 97 (Borden Chemical), formaldehyde polymers with ammonia, cresol and phenol, such as VARCUM® 29112 (OxyChem Company), formaldehyde polymers with 4,4'-(1-methylethylidene)bisphenol, such as VARCUM® 29108 and 29116 (OxyChem Company), formaldehyde polymers with cresol and phenol, such as VARCUM® 29457 (OxyChem Company), DURITE® SD-423A, SD-422A (Borden Chemical), or formaldehyde polymers with phenol and p-tert-butylphenol, such as DURITE® ESD 556C (Borden Chemical).

For novolac-type phenolic resin (or novolac phenolic resins), a weight average molecular weight of the resin may be from, for example, about 300 to about 50,000, about 500 to about 35,000, or from about 1,000 to about 35,000, for example as determined by known methods such as gel permeation chromatography. Examples of novolac phenolic resins include 471×75 (cured with HY283 amide hardener), ARALDITE™ PT810, ARALDITE™ MY720, and ARALDITE™ EPN 1138/1138 A-84 (multifunctional epoxy and epoxy novolac resins) from Ciba-Geigy; ECN™ 1235, 1273 and 1299 (epoxy cresol novolac resins) from Ciba-Geigy; TORLON™ AI-10 (poly(amideimide)resin) from Amoco; THIXON™ 300/301 from Whittaker Corp.; TACTIX™ (tris(hydroxyphenyl)methane-based epoxy resins, oxazolidenone modified tris(hydroxyphenyl)methane-based epoxy resins, and multifunctional epoxy-based novolac resins) from Dow Chemical; and EYMYD™ resin L-20N (polyimide resin) from Ethyl Corporation, and the like.

The novolac phenolic resin may be used in combination with or as an admixture of a resole-type phenol resin. The novolac phenolic resin may further include a phenol compound containing a hydroxymethyl group. Illustrative examples of phenol compounds include 2,6-bis(hydroxymethyl)phenol, 2,4-bis(hydroxymethyl)phenol, 2,4,6-tris(hydroxymethyl)phenol, 2,6-bis-(hydroxymethyl)cresol, and the like. The resole-type phenol resin or the hydroxymethyl phenol compound included in the novolac resin may be present, for example, in an amount of from about 5 to about 50 weight of the resin mixture.

The overcoat resin in embodiments may include, for example, from about 25 to about 60 percent by weight of the phenolic charge transport component although other amounts can be used. The thickness of the overcoat layer depends on many factors, including mechanical robustness, electrical characteristics, and the like, thus the thickness may be, for example, from about 0.5 to about 10 microns, or from about 1 to about 5 microns.

For achieving improved mechanical robustness, the overcoat layer in embodiments may be crosslinked or cured. The crosslinked overcoat can typically be accomplished by applying the phenol resin and the charge transport component of Formula 1 as a mixture onto the charge transport layer, followed by heating the mixture in the presence of a catalyst. The catalyst may be present in the overcoat coating composition in an amount from about 0.01 weight percent to about 10 weight percent, such as from about 0.1 weight percent to about 5 weight percent or from about 0.5 weight percent to about 3 weight percent, of the overcoat coating composition.

The thickness of the overcoat layer after curing may be from about 0.5 micron to about 10 microns, or from about 1 micron to about 5 microns. The temperature selected for crosslinking is dependent on the specific catalyst, heating times, and the degree of crosslinking desired. Generally, the degree of crosslinking selected depends upon the desired flexibility of the final photoreceptor. For example, crosslinking may be used for a rigid drum or plate photoreceptors. However, partial crosslinking can be beneficial for flexible photoreceptors having, for example, web or belt configurations. The degree of crosslinking can be controlled by the relative amount of catalyst employed. The amount of catalyst to achieve a desired degree of crosslinking will vary depending upon the specific coating solution materials, such as the hydroxyl group containing compound, catalyst, temperature and time used for the reaction. In embodiments, the curing temperature may range from about 50° C. to about 200° C., or from about 80° C. to about 150° C. During the curing process, the solvent used for preparing the coating solution is removed by vapor evaporation. After crosslinking, the overcoating should be substantially insoluble in the solvent in which it was soluble prior to crosslinking. Thus, in embodiments substantially no overcoating material will be removed when rubbed with a cloth soaked in the solvent. Crosslinking results in the development of a three dimensional network which restrains the transport molecule in the crosslinked polymer network.

Any suitable catalyst may be employed. Typical catalysts include, for example, an organic acid such as a methanesulfonic acid, a benzenesulfonic acid, a toluenesulfonic acid, a naphthalenesulfonic acid, trifluoroacetic acid, oxalic acid, acetic acid, formic acid, glycolic acid, glyoxylic acid, and the like; a polymeric acid such as poly(acrylic acid), poly(vinyl chloride-co-vinyl acetate-co-maleic acid), and the like; an inorganic acid such as hydrochloric acid; Lewis acids such as zinc acetate, aluminum acetylacetonate, and the like; a benzenesulfonic acid such as p-toluenesulfonic acid; mixtures thereof, derivatives thereof, and the like. Catalyst derivatives refer to, for example, salts thereof, for example salts with an organic base, such as pyridine, piperidine, and the like. Commercially available catalysts, such as CYCAT™ 4040, available from Cytec Industries Inc., and NACURE™ 5225, available from King Industries, may also be selected.

Methods for applying the overcoat onto the photoreceptor include spraying, dip coating, roll coating, wire wound rod coating, and the like. For many coating techniques, the phenol resin containing the phenolic charge transport component, and optionally the catalyst, may be diluted with an organic solvent. A number of suitable alcohol solvents may be selected for the overcoat composition, such as alcohol solvents including, for example, butanol, propanol, methanol, ethanol, 1-methoxy-2-propanol, and the like, and mixtures thereof. Other suitable solvents that can be used in forming the overcoat layer solution include, for example, tetrahydrofuran, monochlorobenzene, and mixtures thereof, and which solvents can be used in addition to, or in place of, the above alcohol solvents. The solvent amount is, for example, from about 50 to about 90 weight percent of the total coating solution, although other amounts can be used to, for example, obtain uniform coating.

The charge transport layer usually in contact with the photogenerating layer comprises charge transport molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to charge transporting molecules dispersed in the polymer, the small molecules being dispersed in the polymer on a molecular scale. A charge transport layer should be an insulator to the extent that an electrostatic charge placed on the charge transport layer is not conducted in the absence of illumination at a rate sufficient to prevent formation and retention of an electrostatic latent image thereon. Typically, a charge transport layer is substantially non-absorbing to visible light or radiation in the region of intended use but is electrically active in that it allows the injection of photogenerated holes from the photoconductive layer, that is charge generation layer, and allows these holes to be transported through itself to selectively discharge a surface charge on the surface of the active layer. Various suitable charge transporting or electrically active small molecules may be selected for the charge transport layer or layers. Generally, the transport layer contains from about 10 to about 75 percent by weight of the charge transport material, and more specifically, from about 35 percent to about 50 percent of this material. The charge transport layer is, for example, of a thickness of from about 10 to about 50 microns, or from about 20 to about 40 microns.

A number of suitable known charge transport components can be selected for the charge transporting layer such as, for example, aryl amines represented by the following formula/structure

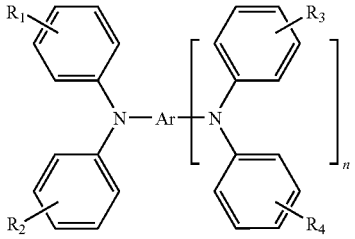

wherein $R_1$, $R_2$, $R_3$, and $R_4$ are each independently selected from the group consisting of at least one of hydrogen, alkyl with, for example, from about 1 to about 15 carbon atoms, alkoxy with, for example, from about 1 to about 15 carbon atoms, aryl with, for example, from about 6 to about 36 carbon atoms, aryloxy with, for example, from about 6 to about 36 carbon atoms, and a halogen; Ar is an aromatic hydrocarbon group with, for example, from about 6 to about 36 carbon atoms, and n represents the number of repeating segments such as 0, 1, 2 or 3. The benzene rings and the Ar group disclosed herein may further contain a substituent such as an alkyl, an alkoxy, a halogen, and the like. Illustrative examples of alkyl groups are as disclosed herein, such as methyl, ethyl, propyl, butyl, and the like. Suitable examples for the aromatic Ar group include a biphenyl, a terphenyl, a tetraphenyl, and the like. The alkoxy group may include a methoxy, ethoxy, a propoxy, and the like. Examples of aryl groups are a phenyl, a naphthyl, a biphenylyl, and the like.

Specific examples of components for the charge transport layer include hole transporting components, and molecules of the following formula

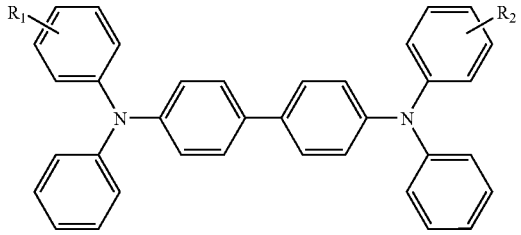

wherein $R_1$ and $R_2$ are each an alkyl, an alkoxy, an aryl, a halogen, and the like. The alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain, for example, from 6 to about 36 carbon atoms, such as phenyl, and the like. Halogen includes chloride, bromide, iodide, and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; and the like. Other known charge transport layer molecules can be selected, reference for example, U.S. Pat. Nos. 4,921,773 and 4,464,450, the disclosures of which are totally incorporated herein by reference.

Further specific examples of components for the charge transport layer include hole transporting components and molecules of the following formula

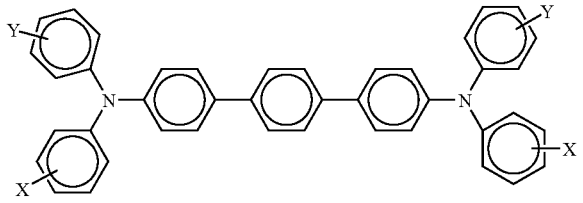

wherein X and Y are at least one of alkyl, alkoxy, aryl, and halogen. Examples of these components include N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures thereof.

Suitable examples of the binder materials selected for the charge transport layer include polymer components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly(4,4'-isopropylidene-diphenylene) carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, or with a molecular weight $M_w$ of from about 50,000 to about 100,000 can be selected. The charge transport layer may generally be fabricated by dissolving the charge transport molecule and the polymer binder in a suitable solvent to form a coating solution, followed by coating and drying of the coating solution. Examples of solvents include hydrocarbons such as toluene and xylene, halogenated hydrocarbons such as dichloromethane and chlorobenzene, ethers such as tetrahydrofuran, and the like. The coating of the charge transport layer of the present disclosure can be accomplished with spray, dip or wire-bar methods. The solvent may be removed after the coating by drying at a temperature ranging from, for example, about 40° C. to about 150° C.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate)methane (IRGANOX 1010™, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40 AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

The photogenerating layer in embodiments is comprised of, for example, a number of components that permit the photogeneration of charge, such as metal phthalocyanines, metal free phthalocyanines, titanyl phthalocyanines, such as Type V titanyl phthalocyanine, hydroxygallium phthalocyanines, halogallium phthalocyanines, perylenes, selenium, and the like. A specific example of a photogenerating pigment that can be selected for the photogenerating layer is Type V hydroxygallium phthalocyanine or chlorogallium phthalocyanine dispersed in a resin binder like poly(vinyl chloride-co-vinyl acetate) copolymer, such as VMCH (available from Dow Chemical). Generally, the photogenerating layer can contain a polymer and known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating layer may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition; inorganic pigments of crystalline selenium and its alloys; Groups II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.01 micron to about 30 microns, and more specifically, from about 0.25 micron to about 5 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin may be selected from a number of known polymers, such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating component pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

A charge blocking layer or hole blocking layer may optionally be applied to the substrate prior to the application of the photogenerating layer. When desired, an adhesive layer may be included between the charge blocking, hole blocking layer or interfacial layer and the photogenerating layer. Usually, the photogenerating layer is applied onto the blocking layer and a charge transport layer or plurality of charge transport layers are formed on the photogenerating layer.

The hole blocking or undercoat layers for the imaging members of the present disclosure can contain a number of components including known hole blocking components. A suitable hole blocking layer may be comprised of polymers, such as polyvinyl butyral, epoxy resins, polyesters, polysiloxanes, polyamides, polyurethanes, and the like, nitrogen-containing siloxanes or nitrogen-containing titanium compounds, such as trimethoxysilyl propyl ethylene diamine, N-beta (aminoethyl)gamma-aminopropyl trimethoxy silane, isopropyl 4-aminobenzene sulfonyl titanate, di(dodecylbenzene sulfonyl)titanate, isopropyl di(4-aminobenzoyl)isostearoyl titanate, isopropyl tri(N-ethyl amino)titanate, isopropyl trianthranil titanate, isopropyl tri(N,N-dimethyl-ethyl amino)titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, for example as disclosed in U.S. Pat. Nos. 4,338,387, 4,286,033 and 4,291,110, the disclosures of which are totally incorporated herein by reference.

A suitable hole blocking layer may also be comprised of a polymer composite composition comprising n-type metal oxide particles, for example as disclosed in U.S. Pat. Nos. 6,261,729 and 6,946,226, each incorporated herein by reference in their entireties. The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Borden Chemical).

In embodiments, a suitable known adhesive layer can be included in the photoconductor. Typical adhesive layer materials include, for example, copolyesters, polyamides, poly (vinylbutyral), poly(vinylalcohol), polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The thickness of the photoconductor substrate layer depends on many factors, including economical considerations, electrical characteristics, and the like, thus this layer may be of substantial thickness, for example over 3,000 microns, such as from about 300 to about 700 microns, or of a minimum thickness. In embodiments, the thickness of this layer is from about 75 microns to about 300 microns, or from about 100 to about 150 microns.

The substrate may be opaque or substantially transparent and may comprise any suitable material having the required mechanical properties. Accordingly, the substrate may comprise a layer of an electrically nonconductive or conductive material such as an inorganic or an organic composition. As electrically nonconducting materials, there may be selected various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. For a drum, this layer may be of substantial thickness of, for example, up to many centimeters or of a minimum thickness of less than a millimeter. Similarly, a flexible belt may be of substantial thickness of, for example, about 250 micrometers, or of minimum thickness of less than about 50 micrometers, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent, comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer such as, for example, polycarbonate materials commercially available as MAKROLON®.

Primarily for purposes of brevity, the examples of each of the substituents and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups and mixtures thereof. Also, the carbon chain lengths are intended to include all numbers between those disclosed or claimed or envisioned, thus from 1 to about 20 carbon atoms, and from 6 to about 42 carbon atoms includes 1, 2, 3, 4, 5, 6, 7, 8, 9, 10, 11, 12, 13, 14, 15 up to 42, or more. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

EXAMPLES

An electrophotographic photoreceptor was fabricated in the following manner. A coating solution for an undercoat layer comprising 100 parts of a zirconium compound (ORGATICS™ ZC540), 10 parts of a silane compound (A110™, manufactured by Nippon Unicar Co., Ltd), 400 parts of an isopropanol solution, and 200 parts of butanol was prepared. The coating solution was applied onto a cylindrical aluminum (Al) substrate subjected to a honing treatment by dip coating, and dried by heating at 150° C. for 10 minutes to form an undercoat layer having a film thickness of 0.1 micrometer.

A 0.5 micron thick charge generating layer was subsequently dip coated on top of the undercoat layer from a dispersion of Type V hydroxygallium phthalocyanine (12 parts), alkylhydroxy gallium phthalocyanine (3 parts), and a vinyl chloride/vinyl acetate copolymer, VMCH™ ($M_n$=27,000, about 86 weight percent of vinyl chloride, about 13 weight percent of vinyl acetate, and about 1 weight percent of maleic acid), available from Dow Chemical (10 parts), in 475 parts of n-butylacetate.

Subsequently, a 20 μm thick charge transport layer (CTL) was dip coated on top of the charge generating layer from a solution of N,N'-diphenyl-N,N'-bis(3-methylphenyl)-1,1'-biphenyl-4,4'-diamine (82.3 parts), 2.1 parts of 2,6-di-tert-butyl-4-methylphenol (BHT), available from Aldrich, and a polycarbonate, PCZ-400, poly(4,4'-dihydroxy-diphenyl-1-1-cyclohexane), $M_w$=40,000, available from Mitsubishi Gas Chemical Company, Ltd. (123.5 parts), in a mixture of 546 parts of tetrahydrofuran (THF) and 234 parts of monochlorobenzene. The CTL was dried at 115° C. for 60 minutes.

An overcoat formulation was prepared as follows: a mixture of a resole-type phenol-formaldehyde resin (5.04 parts), a phenolic charge transport component of N,N'-bis(3-hydroxyphenyl)-N,N'-diphenyl-1,1'-biphenyl-4,4'-diamine (3 parts), and a catalyst of p-toluenesulfonic acid pyridine complex (0.3 part) was dissolved in a solvent of 1-methoxy-2-propanol (5.4 parts). After filtering with a 0.45 μm PTFE filter, the solution was applied onto the photoreceptor surface, and more specifically, onto the charge transport layer, using a cup coating technique, followed by thermal curing at 150° C. for 35 minutes to form an overcoat layer having a film thickness of 3 μm. The resulted overcoat resin layer contained about 30 to about 35 weight percent of the charge transport component, and the remainder about 65 to about 70 weight percent of resin.

A Comparative Example photoreceptor or photoconductor was prepared by repeating the above process except that the overcoat layer was omitted.

Evaluation of Photoreceptor Performance:

The electrical performance characteristics of the above prepared photoreceptors, such as electrophotographic sensitivity and short term cycling stability, were tested in a scanner. The scanner was known in the industry and equipped with means to rotate the photoconductor drum while it was electrically charged and discharged. The charge on the photoconductor sample was monitored by electrostatic probes placed at precise positions around the circumference of the photoconductor or photoreceptor. The photoreceptor devices were charged to a negative potential of 500 volts. As the devices rotated, the initial charging potentials were measured by voltage probe 1. The photoconductor samples were then exposed to monochromatic radiation of known intensity, and the surface potential measured by voltage probes 2 and 3. Finally, the samples were exposed to an erase lamp of appropriate intensity and wavelength, and any residual potential was measured by voltage probe 4. The process was repeated under the control of the scanner's computer, and the data was stored in the computer. The PIDC (photoinduced discharge curve) was obtained by plotting the potentials at voltage probes 2 and 3 as a function of the light energy. The photoreceptor having the overcoat layer showed comparable PIDC characteristics as the control or Comparative Example device.

The electrical cycling performance of the photoreceptor was performed using an in house fixture similar to a xerographic system. The photoreceptor device with the overcoat showed stable cycling of over 170,000 cycles in a humid environment (28° C., 80 percent RH).

The wear resistance for the above photoconductors was measured using an in house testing fixture comprising a BCR (bias-charging roller) charging unit, an exposure unit, a toner developer unit, and a cleaning unit. The photoreceptors were set to rotate at about 88 RPM for 50,000 cycles. The thickness of the photoreceptor was measured at the beginning and at the end of the testing. The wear rate was estimated based on the thickness loss expressed in nanometers per kilocycle. The above photoreceptor with the overcoat offered a wear rate of about 21 nanometers/kc, as compared to the higher wear rate of about 85 nanometers/kc for the control.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. An imaging member comprising a supporting substrate, a photogenerating layer, a charge transport layer comprising a charge transport component selected from the group consisting of N,N'-bis(4-butylphenyl)-N,N'-di-p-tolyl-[p-terphenyl]-4,4'-diamine, and N,N'-bis(4-butylphenyl)-N,N'-di-m-tolyl-[p-terphenyl]-4,4'-diamine, and mixtures thereof, and an overcoat layer comprised of a resole-type phenol-formaldehyde resin cross-linked to a phenolic charge transport component selected from the group consisting of N,N'-bis(3-hydroxyphenyl)-N,N'-diphenyl-1,1'-biphenyl-4,4'-diamine, N,N'-bis(4-hydroxyphenyl)-N,N'-diphenyl-1,1'-biphenyl-4,4'-diamine, N,N'-bis(4-hydroxyphenyl)-N,N'-di-m-tolyl-1,1'-biphenyl-4,4'-diamine, and N,N'-bis(3-hydroxyphenyl)-N,N'-di-m-methoxyphenyl-1,1'-biphenyl-4,4'-diamine, wherein the resole-type phenol-formaldehyde resin has a weight average molecular weight of from about 300 to about 50,000 and the overcoat layer comprises from about 30 to 35 weight percent of the phenolic charge transport component with the remainder consisting of the resole-type phenol-formaldehyde resin; wherein the components of the resole-type phenol-formaldehyde resin and the phenolic charge transport component are applied as a mixture onto the charge transport layer, and followed by heating the mixture in the presence of a catalyst; and wherein the charge transport component in the charge transport layer is different than the phenol resin containing phenolic charge transport component in the overcoat layer.

2. An imaging member in accordance with claim 1 wherein the crosslinking is generated by thermal curing of the phenol resin containing the phenolic charge transport component in the presence of a catalyst, and wherein said phenol resin contains from about 20 to about 75 percent of the phenolic charge transport component.

3. An imaging member in accordance with claim 1 wherein said photogenerating layer is comprised of a photogenerating pigment selected from the group consisting of a metal free phthalocyanine, a hydroxygallium phthalocyanine, a titanyl phthalocyanine, a chlorogallium phthalocyanine, a perylene, and mixtures thereof.

4. An imaging member in accordance with claim 1 further including a hole blocking layer in contact with the substrate.

5. An imaging member in accordance with claim 4 wherein said blocking layer is comprised of a polyaminosiloxane.

6. An imaging member in accordance with claim 4 wherein said blocking layer is comprised of metal oxide particles dispersed in a polymer.

7. An imaging member in accordance with claim 1 wherein said photogenerating layer and said charge transport layer are comprised of a single layer.

8. A photoconductor comprising in sequence a supporting substrate, a hole blocking layer thereover, a photogenerating layer, at least one charge transport layer comprising a charge transport component selected from the group consisting of N,N'-bis(4-butylphenyl)-N,N'-di-p-tolyl-[p-terphenyl]-4,4'-diamine, and N,N'-bis(4-butylphenyl)-N,N'-di-m-tolyl-[p-terphenyl]-4,4'-diamine, and mixtures thereof, and an overcoat layer comprised of a crosslinked product of a resole-type phenol-formaldehyde resin and a phenolic charge transport component selected from the group consisting of N,N'-bis(3-hydroxyphenyl)-N,N'-diphenyl-1,1'-biphenyl-4,4'-diamine, N,N'-bis(4-hydroxyphenyl)-N,N'-diphenyl-1,1'-biphenyl-4,4'-diamine, N,N'-bis(4-hydroxyphenyl)-N,N'-di-m-tolyl-1,1'-biphenyl-4,4'-diamine, and N,N'-bis(3-hydroxyphenyl)-N,N'-di-m-methoxyphenyl-1,1'-biphenyl-4,4'-diamine, wherein the resole-type phenol-formaldehyde resin has a weight average molecular weight of from about 300 to about 50,000 and the overcoat layer comprises from about 30 to 35 weight percent of the phenolic charge transport component with the remainder consisting of the resole-type phenol-formaldehyde resin, and further wherein the charge transport component in the charge transport layer is different than the phenolic charge transport component in the overcoat layer; wherein the components of the resole-type phenol-formaldehyde resin and the phenolic charge transport component are applied as a mixture onto the charge transport layer, and followed by heating the mixture in the presence of a catalyst.

9. A photoconductor in accordance with claim 8 wherein said phenolic charge transport component is N,N'-bis(3-hydroxyphenyl)-N,N'-diphenyl-1,1'-biphenyl-4,4'-diamine.

10. A photoconductor in accordance with claim 8 wherein said catalyst is a benzenesulfonic acid or its amine salt.

11. A photoconductor in accordance with claim 8 wherein said substrate is aluminum or a metallized polymer; said blocking layer is comprised of a polyaminosiloxane, and which blocking layer is of a thickness of from about 0.1 to about 3 micron thickness, or a blocking layer of a metal oxide polymer with a layer thickness of from about 1 to about 20 microns; said photogenerating layer is comprised of a phthalocyanine pigment, and a polymer with a layer thickness of from about 0.1 to about 3 microns; said charge transport layer is comprised of a tertiary arylamine blended into a polymer with a layer thickness of from about 10 to about 35 microns; said overcoat layer is comprised of a crosslinked product of a resole-type phenol-formaldehyde resin, and N,N'-bis(3-hydroxyphenyl)-N,N'-diphenyl-1,1'-biphenyl-4,4'-diamine with a layer thickness of from about 1 to about 6 microns.

12. A photoconductor in accordance with claim 8 wherein said blocking layer is comprised of at least one of a polysiloxane with a layer thickness of from about 0.03 to about 3 microns, and from about 25 to about 60 weight percent of metal oxide particles dispersed in a polymer with a layer thickness of from about 1 to about 25 microns; said photogenerating layer comprises from about 40 to about 90 weight percent of a photogenerating pigment with a layer thickness of from about 0.1 to about 3 microns; said charge transport layer comprises from about 25 to about 70 weight percent of a tertiary arylamine with a layer thickness of from about 10 to about 40 microns; and said overcoat layer comprises from about 25 to about 60 weight percent of the charge transport component with a layer thickness of from about 0.5 to about 10 microns.

13. A photoconductor in accordance with claim 12 wherein said polysiloxane layer thickness is from about 0.03 to about 1 micron, from about 5 to about 20 microns, from about 0.2 to about 1 micron, from about 15 to about 35 microns, or from about 1 to about 5 microns.

14. A photoconductor in accordance with claim 8 wherein said charge transport layer is comprised of hole transport molecules dispersed, in a resin binder, and said photogenerating layer is comprised of at least one photogenerating pigment dispersed in a resin binder; wherein at least one charge transport is from 1 to about 4; wherein said crosslinking is from about 20 to about 70 percent.

15. A photoconductor in accordance with claim 8 wherein the photogenerating layer is comprised of a photogenerating pigment of titanyl phthalocyanine, a perylene, a hydroxygallium phthalocyanine, or a mixture of an alkylhydroxygallium phthalocyanine and a hydroxygallium phthalocyanine; the charge transport layer is comprised of an aryl amine; and wherein said overcoat layer is formed from a mixture of a resole-type phenol-formaldehyde resin, a phenolic charge transport component of N,N'-bis(3-hydroxyphenyl)-N,N'-diphenyl-1,1'-biphenyl-4,4'-diamine and a catalyst.

16. A photoconductor comprising in sequence a supporting substrate, a hole blocking layer thereover, a photogenerating layer, at least one charge transport layer comprising a charge transport component selected from the group consisting of N,N'-bis(4-butylphenyl)-N,N'-di-p-tolyl-[p-terphenyl]-4,4'-diamine, and N,N'-bis(4-butylphenyl)-N,N'-di-m-tolyl-[p-terphenyl]-4,4'-diamine, and mixtures thereof, and an overcoat layer comprised of a crosslinked product of a resole-type phenol-formaldehyde resin and a phenolic charge transport component selected from the group consisting of N,N'-bis(3-hydroxyphenyl)-N,N'-diphenyl-1,1'-biphenyl-4,4'-diamine, N,N'-bis(4-hydroxyphenyl)-N,N'-diphenyl-1,1'-biphenyl-4,4'-diamine, N,N'-bis(4-hydroxyphenyl)-N,N'-di-m-tolyl-1,1'-biphenyl-4,4'-diamine, and N,N'-bis(3-hydroxyphenyl)-N,N'-di-m-methoxyphenyl-1,1'-biphenyl-4,4'-diamine, wherein the resole-type phenol-formaldehyde resin has a weight average molecular weight of from about 300 to about 50,000 and the overcoat layer comprises from about 30 to 35 weight percent of the phenolic charge transport component with the remainder consisting of the resole-type phenol-formaldehyde resin, and further wherein the charge transport component in the charge transport layer is different than the charge transport component in the overcoat layer and the resole-type phenol-formaldehyde resin includes from about 5 to about 50 percent of a phenol compound selected from the group consisting of at least one of 2,6-bis(hydroxylmethyl) phenol, 2,4-bis(hydroxymethyl)phenol, 2,4,6-tris(hydroxymethyl)phenol, and 2,6-bis(hydroxymethyl)cresol; wherein the components of the resole-type phenol-formaldehyde resin and the phenolic charge transport component are applied as a mixture onto the charge transport layer, and followed by heating the mixture in the presence of a catalyst.

* * * * *